US009848639B1

(12) United States Patent
Soares

(10) Patent No.: US 9,848,639 B1
(45) Date of Patent: Dec. 26, 2017

(54) WATER PIPE SMOKING SYSTEM

(71) Applicant: John G. Soares, Fall River, MA (US)

(72) Inventor: John G. Soares, Fall River, MA (US)

( * ) Notice: Subject to any disclaimer, the term of this patent is extended or adjusted under 35 U.S.C. 154(b) by 567 days.

(21) Appl. No.: 14/340,020

(22) Filed: Jul. 24, 2014

(51) Int. Cl.
*A24F 1/30* (2006.01)
*A24F 1/02* (2006.01)

(52) U.S. Cl.
CPC . *A24F 1/30* (2013.01); *A24F 1/02* (2013.01)

(58) Field of Classification Search
CPC ..... A24F 1/30
See application file for complete search history.

(56) References Cited

U.S. PATENT DOCUMENTS 3,882,875 A * 5/1975 Frost ..... A24F 1/30 131/173
3,918,464 A 11/1975 Kolodziej
4,014,353 A 3/1977 Kahler
4,142,536 A 3/1979 DeCarlo
4,148,327 A 4/1979 Graham
4,165,753 A 8/1979 Stryker
D256,506 S 8/1980 Graham
4,648,410 A 3/1987 Seroussi
5,738,116 A 4/1998 Truelove
7,806,123 B2 10/2010 Mehio
2008/0072917 A1 3/2008 Lee
2014/0182606 A1* 7/2014 Lotringer ..... A24F 1/30 131/173

* cited by examiner

*Primary Examiner* — Eric Yaary

(57) ABSTRACT

A novel water pipe smoking system features a base chamber having a base chamber cavity connected to a hose. The base chamber is designed to contain a water level and a vapor headspace. The system features one or more stacked filtering liquid lock chambers each having a filtering liquid lock chamber cavity. The filtering liquid lock chamber is designed to contain a water level and a vapor headspace. The system features one or more chamber connecting lids each having an open tube. The filtering liquid lock chamber is attached to either another filtering liquid lock chamber or the base chamber via the chamber connecting lid. The system features a stem cap having an open tube that is attached to a topmost filtering liquid lock chamber at a filtering liquid lock chamber top. The system features a medicine bowl located on the filtering liquid lock chamber lid.

2 Claims, 4 Drawing Sheets

WATER PIPE SMOKING SYSTEM

FIELD OF THE INVENTION

The present invention relates to devices or systems used for smoking an herbal substance and all tobaccos.

BACKGROUND OF THE INVENTION

Smoking of herbal substances such as tobacco or cannabis using a water pipe has been around in eastern cultures for centuries. Benefits of using a water pipe device include cleaner ingestion via double water filtration, cooler smoke and a smoother draw. Improvements were needed in traditional designs, however, with the recent development of the legality of cannabis for use in medical treatment. The present invention features a novel water pipe smoking system that is versatile, effectively cleans vapors via two or three independent liquid filtering chambers, and is easy to clean for use of cannabis in medical treatment. The present invention demonstrates true multiple filtration, eliminating soot, ash, and tar effectively providing clean ingestion via liquid catch filtration.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a novel water pipe smoking system that is versatile, effectively cleans vapors via two or three independent liquid filtering chambers, and is easy to clean for use of cannabis in medical treatment. In some embodiments, the water pipe smoking system provides cleaner ingestion via a double water filtration system, cooler smoke, and a smoother draw for a user during use. In some embodiments, the system comprises a base chamber having a base chamber cavity. In some embodiments, a hose is located on a base chamber side wall proximal to a base chamber top and fluidly connected to the base chamber cavity. In some embodiments, the base chamber is designed to contain a water level in a base chamber lower half and a vapor headspace in a base chamber upper half.

In some embodiments, the system comprises one or more filtering liquid lock chambers having a filtering liquid lock chamber cavity. In some embodiments, the filtering liquid lock chamber is designed to contain a water level in a filtering liquid lock chamber lower half and a vapor headspace in a filtering liquid lock chamber upper half.

In some embodiments, the system comprises one or more chamber connecting lids having an open tube passing there through. In some embodiments, the filtering liquid lock chamber is removably attached to either another filtering liquid lock chamber or the base chamber via the chamber connecting lid. In some embodiments, the filtering liquid lock chamber cavity is fluidly connected to either another filtering liquid lock chamber cavity or the base chamber cavity via the open vapor transfer tube.

In some embodiments, the system comprises a stem cap having an open tube passing there through. In some embodiments, the filtering liquid lock chamber lid is removably attached to a topmost filtering liquid lock chamber at a filtering liquid lock chamber top. In some embodiments, the filtering liquid lock chamber vapor cavity is fluidly connected to an atmosphere immediately outside the filtering liquid lock chamber.

In some embodiments, the system comprises a medicine bowl located on the filtering liquid lock chamber lid. In some embodiments, the medicine bowl is fluidly connected to the filtering liquid lock vapor transfer tube. In some embodiments, water is placed in the base chamber and one or more filtering liquid lock chambers. In some embodiments, an herbal substance or tobacco is placed in the medicine bowl. In some embodiments, the herbal substance or tobacco is ignited creating a smoke for inhalation via a mouth of a user from the hose.

DESCRIPTION OF PREFERRED EMBODIMENTS

Figure 1:
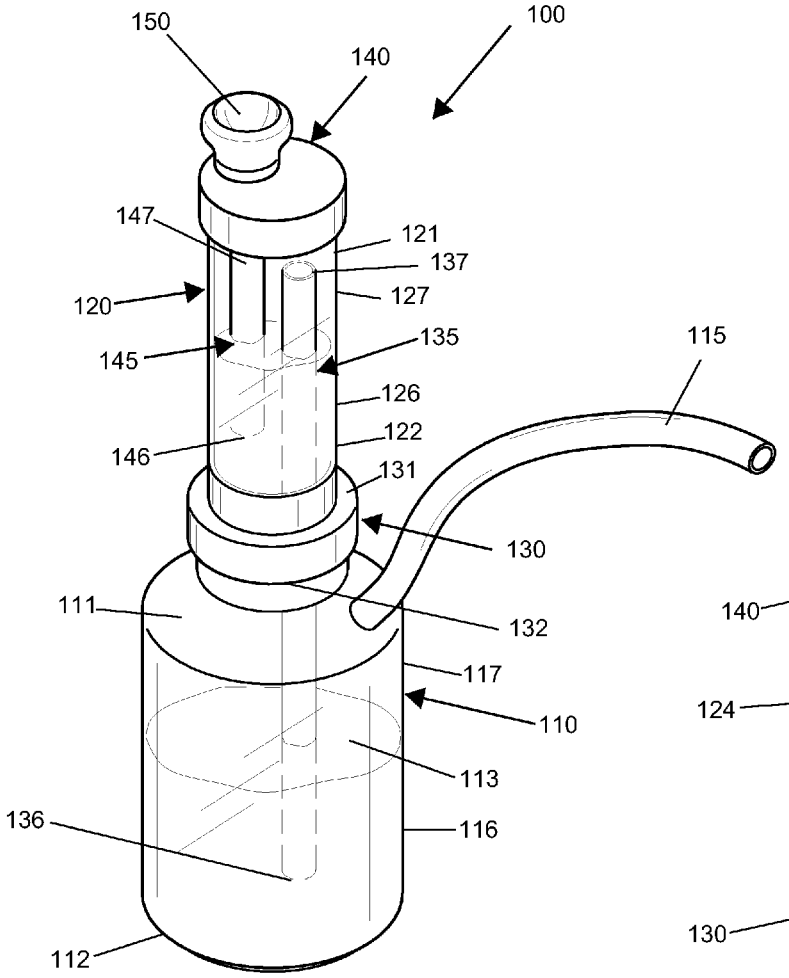
FIG. 1 shows a perspective view of the present invention.
Figure 2:
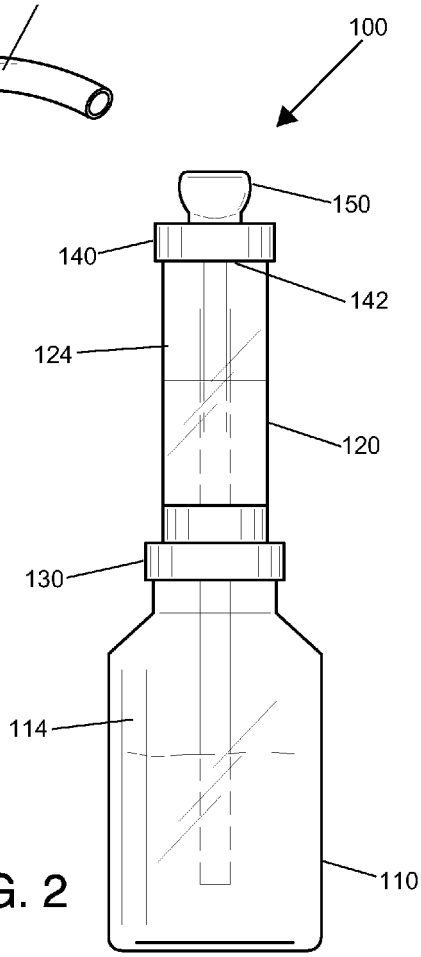
FIG. 2 shows a back view of the present invention.
Figure 3:
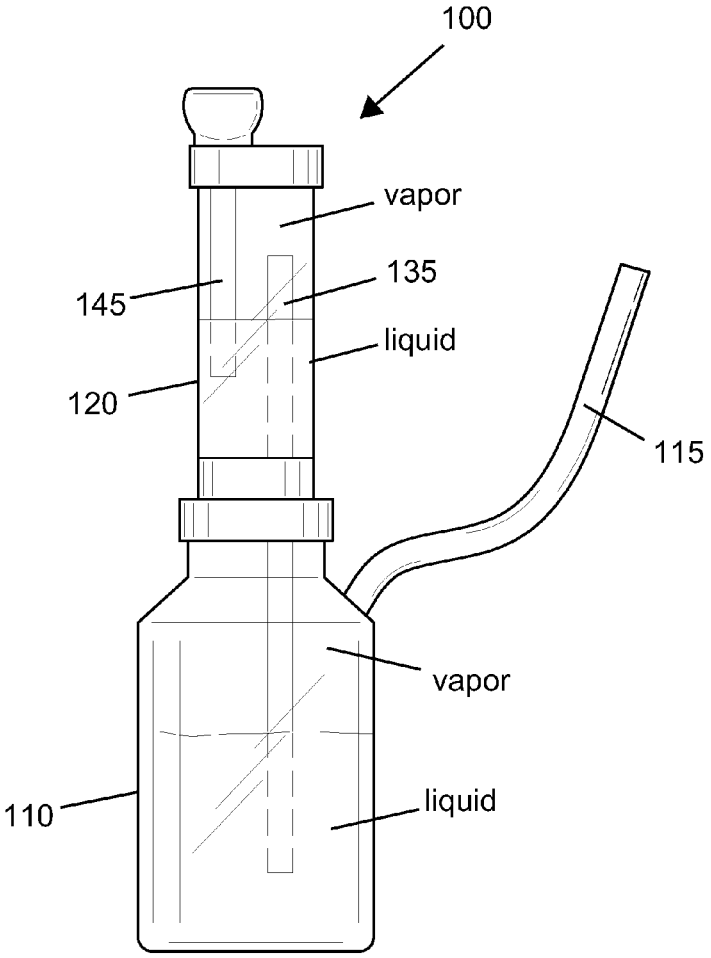
FIG. 3 shows a side view of the present invention.
Figure 4:
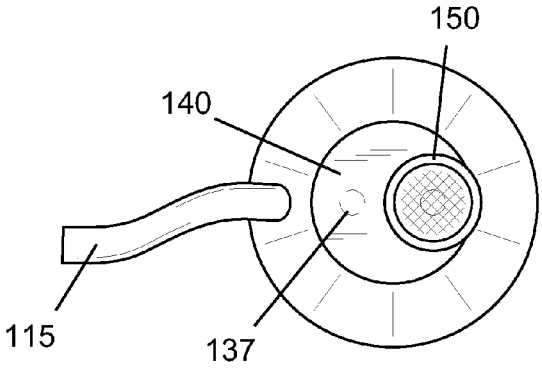
FIG. 4 shows a top view of the present invention.
Figure 5:
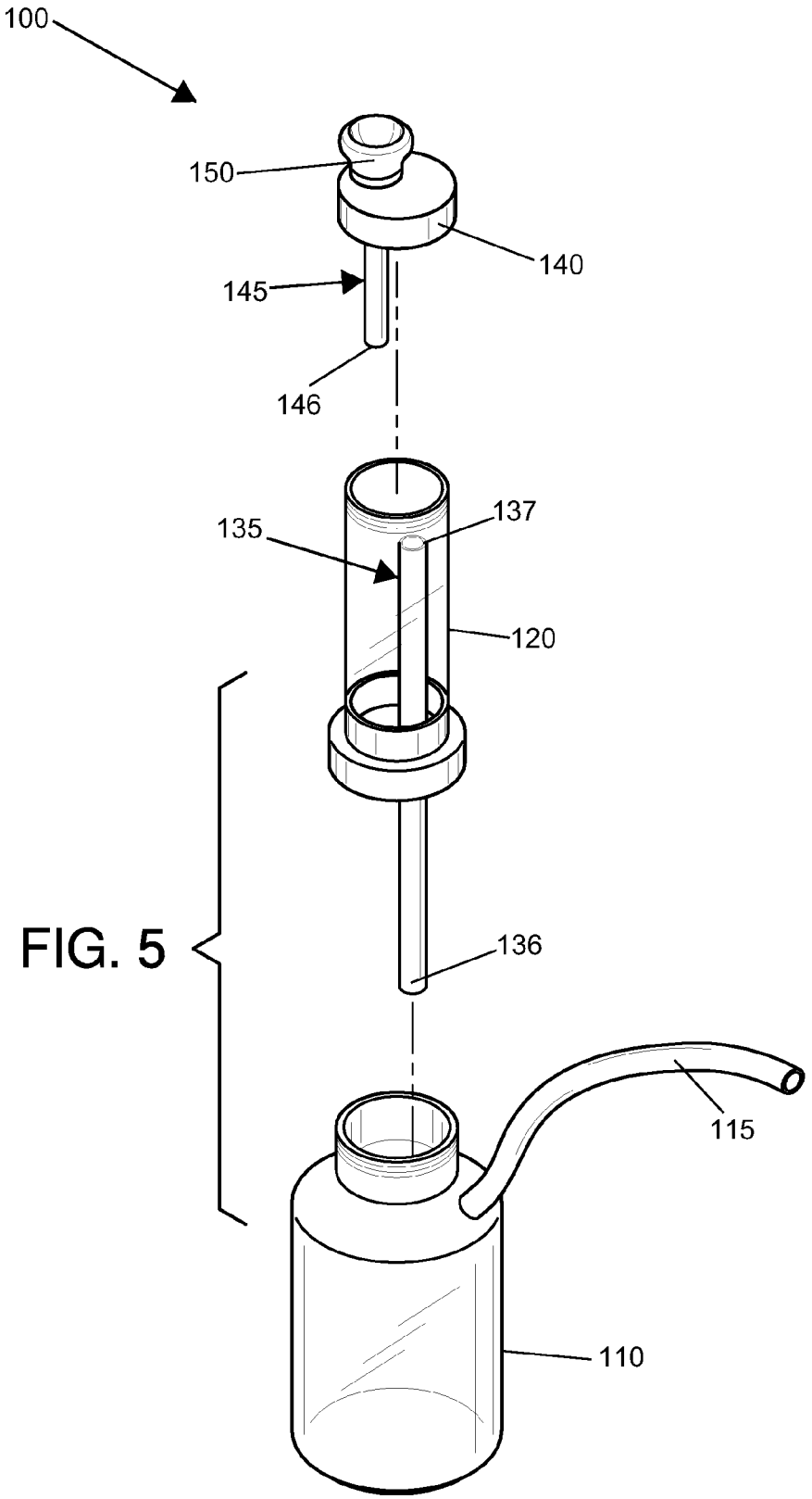
FIG. 5 shows an exploded view of the present invention.
Figure 6:
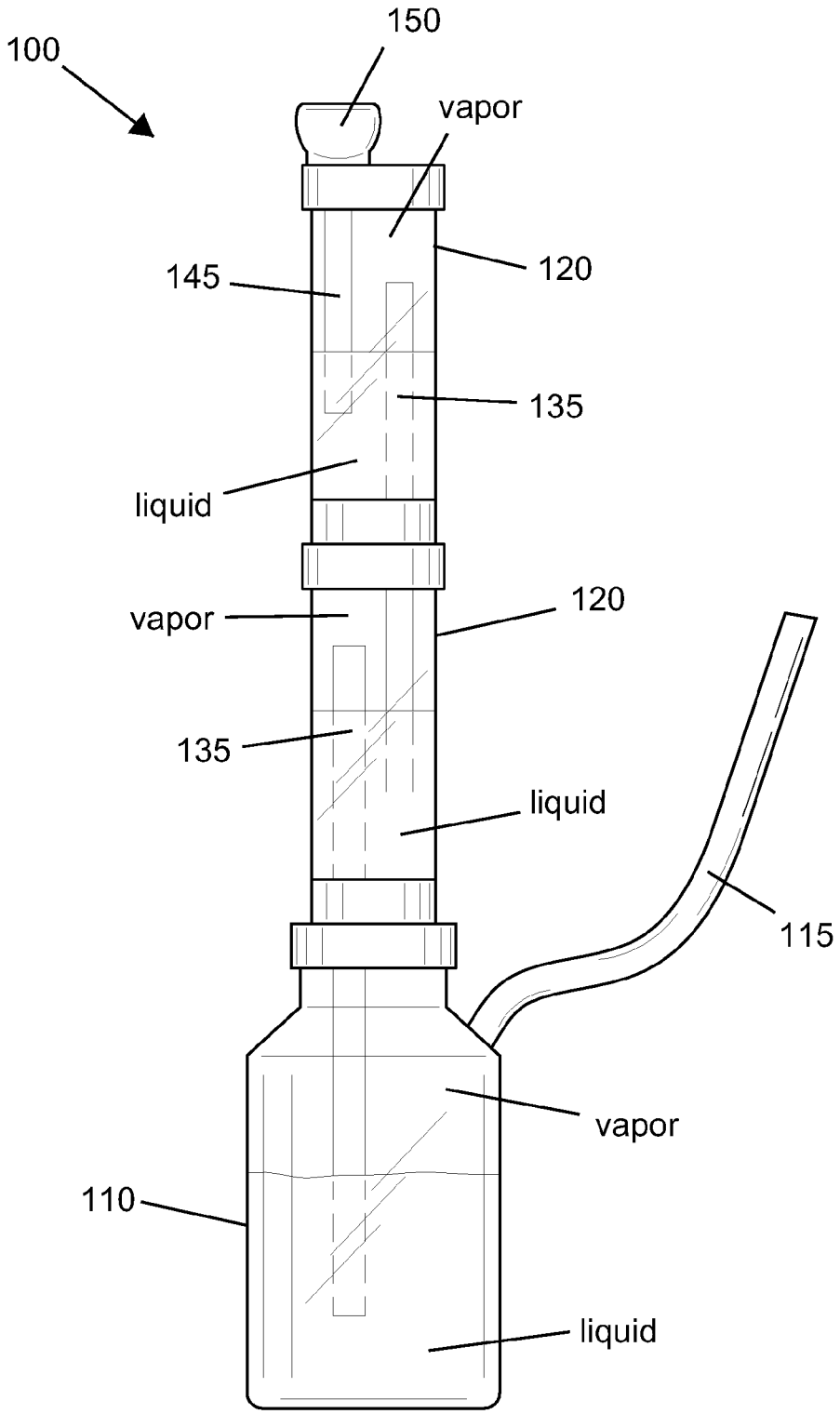
FIG. 6 shows a side view of an alternate embodiment of the present invention.

Following is a list of elements corresponding to a particular element referred to herein:

100 Water pipe smoking system
110 Base chamber
111 Base chamber top
112 Base chamber bottom
113 Base chamber side wall
114 Base chamber cavity
115 Hose
116 Base chamber lower half
117 Base chamber upper half
120 Filtering liquid lock chamber
121 Filtering liquid lock chamber top
122 Filtering liquid lock chamber bottom
124 Filtering liquid lock chamber cavity
126 Filtering liquid lock chamber lower half
127 Filtering liquid lock chamber upper half
130 Chamber connecting lid
131 Chamber connecting lid top end
132 Chamber connecting lid bottom end
135 Vapor transfer tube
136 Lowermost vapor transfer tube end
137 Uppermost vapor transfer tube end
140 Stem cap
142 Stem cap bottom end
145 Top medicine bowl stem
146 Lowermost top medicine bowl stem end
147 Uppermost top medicine bowl stem end
150 Medicine bowl Referring now to FIG. 1-6, the present invention features a novel water pipe smoking system (100) providing cooler smoke, a smoother draw, and cleaner ingestion during use. In some embodiments, the system (100) comprises a base chamber (110) having a base chamber cavity (114) located therein. In some embodiments, the base chamber (110) comprises an open base chamber top (111), a closed base chamber bottom (112) and a base chamber side wall (113). In some embodiments, a hose (115) is located on the base chamber side wall (113) close to the base chamber top (111)

and fluidly connected to base chamber cavity (114). In some embodiments, the base chamber (110) is designed to contain a water level in a base chamber lower half (116) and a vapor headspace in a base chamber upper half (117). In some embodiments, the vapor headspace is designed to contain smoke.

In some embodiments, the system (100) comprises one or more filtering liquid lock chambers (120) each having a filtering liquid lock chamber cavity (124) located therein. In some embodiments, the filtering liquid lock chamber (120) comprises an open filtering liquid lock chamber top (121) and an open filtering liquid lock chamber bottom (122). In some embodiments, the filtering liquid lock chamber (120) is designed to contain a water level in a filtering liquid lock chamber lower half (126) and a vapor headspace in a filtering liquid lock chamber upper half (127). In some embodiments, the vapor headspace is designed to contain smoke.

In some embodiments, the system (100) comprises a chamber connecting lid (130) having an open vapor transfer tube (135) passing there through. In some embodiments, the vapor transfer tube (135) extends out and away from a chamber connecting lid top end (131). In some embodiments, the tube extends out and away from a chamber connecting lid bottom end (132).

In some embodiments, the filtering liquid lock chamber (120) is removably attached to either another filtering liquid lock chamber (120) or the base chamber (110) via the chamber connecting lid (130) located on the filtering liquid lock chamber bottom (122) and either the second filtering liquid lock chamber top (121) or the base chamber top (111). In some embodiments, the filtering liquid lock chamber cavity (124) is fluidly connected to either another filtering liquid lock chamber cavity (124) or the base chamber cavity (114) via the vapor transfer tube (135). In some embodiments, a lowermost vapor transfer tube end (136) is designed to be submerged beneath the water level in either the base chamber lower half (116) or the filtering liquid lock chamber lower half (126). In some embodiments, an uppermost vapor transfer tube end (137) is designed to project above the water level in the filtering liquid lock chamber lower half (126).

In some embodiments, the system (100) comprises a stem cap (140) having an open top medicine bowl stem (145) passing there through. In some embodiments, the top medicine bowl stem (145) extends out and away from a stem cap bottom end (142). In some embodiments, the filtering liquid lock chamber lid is removably attached to a topmost filtering liquid lock chamber (120) at the filtering liquid lock chamber top (121). In some embodiments, the filtering liquid lock chamber cavity (124) is fluidly connected to an atmosphere immediately outside the filtering liquid lock chamber (120). In some embodiments, a lowermost top medicine bowl stem end (146) is designed to be submerged beneath the water level in the filtering liquid lock chamber lower half (126).

In some embodiments, the system (100) comprises a medicine bowl (150) located on the filtering liquid lock chamber lid. In some embodiments, the medicine bowl (150) is fluidly connected to the filtering liquid lock vapor transfer tube (135) on an uppermost top medicine bowl stem end (147).

In some embodiments, water is located in the base chamber (110) and one or more filtering liquid lock chambers (120). In some embodiments, for use, an herbal substance is located in the medicine bowl (150). In some embodiments, the herbal substance is ignited creating a smoke for inhalation. In some embodiments, the smoke is inhaled via passing through the water via suction from a mouth of a user located on the hose (115).

In some embodiments, the system (100) comprises two or more stacked filtering liquid lock chambers (120).

As used herein, the term "about" refers to plus or minus 10% of the referenced number.

The disclosures of the following U.S. Patents are incorporated in their entirety by reference herein: U.S. Pat. No. D 256,506; U.S. Patent Pub. No. 2008/0072917; U.S. Pat. No. 7,806,123; U.S. Pat. No. 5,738,116; U.S. Pat. No. 4,648,410; U.S. Pat. No. 4,165,753; U.S. Pat. No. 4,148,327; U.S. Pat. No. 4,142,536; U.S. Pat. No. 4,014,353; and U.S. Pat. No. 3,918,464.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A novel water pipe smoking system (100) providing cleaner ingestion, cooler smoke, and a smoother draw during use, wherein the system (100) comprises:

(a) a base chamber (110) having a base chamber cavity (114) disposed therein, wherein the base chamber (110) comprises an open base chamber top (111), a closed base chamber bottom (112) and a base chamber side wall (113), wherein a hose (115) is disposed on the base chamber side wall (113) proximal to the base chamber top (111) and fluidly connected to base chamber cavity (114), wherein the base chamber (10) is designed to contain a water level in a base chamber lower half (116) and a vapor headspace in a base chamber upper half (117);

(b) one or more filtering liquid lock chambers (120) each having a filtering liquid lock chamber cavity (124) disposed therein, wherein the filtering liquid lock chamber (120) comprises an open filtering liquid lock chamber top (121) and an open filtering liquid lock chamber bottom (122), wherein the filtering liquid lock chamber (120) is designed to contain a water level in a filtering liquid lock chamber lower half (126) and a vapor headspace in a filtering liquid lock chamber upper half (127);

(c) a chamber connecting lid (130) having an open vapor transfer tube (135) passing there through, wherein the vapor transfer tube (135) extends out and away from a chamber connecting lid top end (131), wherein the vapor transfer tube (135) extends out and away from a chamber connecting lid bottom end (132), wherein the filtering liquid lock chamber (120) is removably attached to either an other filtering liquid lock chamber (120) or the base chamber (110) via the chamber connecting lid (130) disposed on the filtering liquid lock chamber bottom (122) and either a filtering liquid lock chamber top (121) of the other filtering liquid lock chamber (120) or the base chamber top (111), wherein the filtering liquid lock chamber cavity (124) is fluidly connected to either a filtering liquid lock chamber cavity (124) of the other filtering liquid lock chamber or the base chamber cavity (114) via the vapor transfer tube (135), wherein a lowermost vapor transfer tube end (136) is designed to be submerged beneath the water level in either the base chamber lower half (116) or a lower half of the other filtering liquid lock chamber, wherein an uppermost vapor transfer tube end (137) is designed to project above the water level in the filtering liquid lock chamber lower half (126);

(d) an stem cap (140) having an open top medicine bowl stem (145) passing there through, wherein the top medicine bowl stem (145) extends out and away from a stem cap bottom end (142), wherein the stem cap (140) is removably attached to a topmost filtering liquid lock chamber (120) at the filtering liquid lock chamber top (121), wherein the filtering liquid lock chamber cavity (124) is fluidly connected to an atmosphere immediately outside the filtering liquid lock chamber (120), wherein a lowermost top medicine bowl stem end (146) is designed to be submerged beneath the water level in the filtering liquid lock chamber lower half (126); and (e) a medicine bowl (150) disposed on the stem cap (140), wherein the medicine bowl (150) is fluidly connected to the vapor transfer tube (135) on an uppermost top medicine bowl stem end (147);

wherein water is disposed in the base chamber (110) and one or more filtering liquid lock chambers (120), wherein an herbal substance or tobacco is disposed in the medicine howl (150), wherein the herbal substance or tobacco is ignited creating a smoke for inhalation, wherein the smoke is inhaled via passing through the water via suction from a mouth of a user disposed on the hose (115).

2. The system (100) of claim 1, wherein the system (100) comprises two or more stacked filtering liquid lock chambers (120).

* * * * *